US007602356B2

(12) United States Patent
Myung

(10) Patent No.: US 7,602,356 B2
(45) **Date of Patent: *Oct. 13, 2009**

(54) PLASMA DISPLAY PANEL AND DRIVING METHOD THEREOF

(75) Inventor: Dae Jin Myung, Koyang-shi (KR)

(73) Assignee: LG Electronics Inc., Seoul (KR)

( * ) Notice: Subject to any disclaimer, the term of this patent is extended or adjusted under 35 U.S.C. 154(b) by 353 days.

This patent is subject to a terminal disclaimer.

(21) Appl. No.: 11/298,934

(22) Filed: Dec. 12, 2005

(65) Prior Publication Data

US 2006/0145956 A1 Jul. 6, 2006

Related U.S. Application Data

(63) Continuation of application No. 09/748,118, filed on Dec. 27, 2000, now Pat. No. 6,975,285.

(30) Foreign Application Priority Data

Dec. 28, 1999 (KR) ..... 10-1999-63225

(51) Int. Cl.
*G09G 3/28* (2006.01)

(52) U.S. Cl. ..... 345/60; 345/66; 315/169.4

(58) Field of Classification Search ..... 345/60–68, 345/71

See application file for complete search history.

(56) References Cited

U.S. PATENT DOCUMENTS

| | | | | |
|---|---|---|---|---|
| 5,430,458 | A * | 7/1995 | Weber | 345/60 |
| 6,084,559 | A | 7/2000 | Nagao et al. | 345/67 |
| 6,166,711 | A | 12/2000 | Odake | 345/60 |
| 6,181,305 | B1 | 1/2001 | Nguyen et al. | 345/60 |
| 6,208,082 | B1 * | 3/2001 | Kim et al. | 315/169.1 |
| 6,242,860 | B1 | 6/2001 | Sasao et al. | 313/586 |
| 6,373,452 | B1 | 4/2002 | Ishii et al. | 345/67 |
| 6,384,802 | B1 * | 5/2002 | Moon | 345/60 |
| 6,429,834 | B1 | 8/2002 | Kanazawa et al. | 345/63 |
| 6,525,701 | B1 * | 2/2003 | Kang | 345/60 |
| 6,597,334 | B1 * | 7/2003 | Nakamura | 345/68 |

FOREIGN PATENT DOCUMENTS

| | | |
|---|---|---|
| KR | 1997-17824 | 4/1997 |
| KR | 1998-42245 | 8/1998 |

* cited by examiner

*Primary Examiner*—Kevin M Nguyen
(74) *Attorney, Agent, or Firm*—KED & Associates, LLP

(57) ABSTRACT

A plasma display panel that permits a high-speed addressing. In the panel, scanning/sustaining electrodes are provided at each discharge cell. Common sustaining electrodes are arranged in parallel to the scanning/sustaining electrodes at each discharge cell. At least two dummy electrodes are provided at the non-display area to supply the non-display area with charged particles in the address interval.

11 Claims, 8 Drawing Sheets

PLASMA DISPLAY PANEL AND DRIVING METHOD THEREOF

CROSS-REFERENCE TO RELATED APPLICATIONS

This is a Continuation Application of prior application Ser. No. 09/748,118 filed Dec. 27, 2000, now U.S. Pat. No. 6,975,285. This application claims the benefit of the Korean Application No. P1999-63225 filed on Dec. 28, 1999, which is hereby incorporated by reference.

BACKGROUND OF THE INVENTION

1. Field of the Invention

This invention relates to a plasma display panel, and more particularly to a plasma display panel that permits a high-speed addressing. Also, the present invention is directed to a method of driving said plasma display panel.

2. Description of the Related Art

Recently, a plasma display panel (PDP) feasible to a manufacturing of a large-dimension panel has been highlighted as a flat panel display device. The PDP typically includes a three-electrode, alternating current (AC) surface discharge PDP that has three electrodes and is driven with an AC voltage as shown in FIG. 1.

Referring to FIG. 1, a discharge cell of the three-electrode, AC surface discharge PDP includes a scanning/sustaining electrode 12Y and a common sustaining electrode 12Z formed on an upper substrate 10, and an address electrode 20X formed on a lower substrate 18. On the upper substrate 10 in which the scanning/sustaining electrode 12Y is formed in parallel to the common sustaining electrode 12Z, an upper dielectric layer 14 and a protective film 16 are disposed. Wall charges generated upon plasma discharge are accumulated in the upper dielectric layer 14. The protective film 16 prevents a damage of the upper dielectric layer 14 caused by the sputtering generated during the plasma discharge and improves the emission efficiency of secondary electrons. This protective film 16 is usually made from MgO. A lower dielectric layer 22 and barrier ribs 24 are formed on the lower substrate 18 provided with the address electrode 20X, and a fluorescent material 26 is coated on the surfaces of the lower dielectric layer 22 and the barrier ribs 24. The address electrode 20X is formed in a direction crossing the scanning/sustaining electrode 12Y and the common sustaining electrode 12Z. The barrier ribs 24 is formed in parallel to the address electrode 20X to prevent an ultraviolet ray and a visible light generated by the discharge from being leaked to the adjacent discharge cells. The fluorescent material 26 is excited by an ultraviolet ray generated upon plasma discharge to produce a red, green or blue color visible light ray. An active gas for a gas discharge is injected into a discharge space defined between the upper/lower substrate and the barrier rib.

As shown in FIG. 2, such a discharge cell is arranged in a matrix type. In FIG. 2, the discharge cell 1 is provided at each intersection among scanning/sustaining electrode lines Y1 to Ym, common sustaining electrode lines Z1 to Zm and address electrode lines X1 to Xn. The scanning/sustaining electrode lines Y1 to Ym are sequentially driven while the common sustaining electrode lines Z1 to Zm are commonly driven. The address electrode lines X1 to Xn are driven with being divided into odd-numbered lines and even-numbered lines.

Such a three-electrode, AC surface discharge PDP is driven with being separated into a number of sub-fields. In each sub-field interval, a light emission having a frequency proportional to a weighting value of a video data is conducted to provide a gray scale display. For instance, if a 8-bit video data is used to display a picture of 256 gray scales, then one frame display interval (e.g., 1/60 second=16.7 msec) in each discharge cell 1 is divided into 8 sub-fields SF1 to SF8 as shown in FIG. 3. Each sub-field is again divided into a reset interval, an address interval and a sustaining interval. A weighting value at a ratio of 1:2:4:8: . . . :128 is given to the sustaining interval.

FIG. 4 is waveform diagrams of driving signals applied to each electrode line of the PDP for each sub-field in the conventional driving method. Referring to FIG. 4, one sub-field is divided into a reset interval for initializing an entire field, an address interval for scanning the entire field on a line-sequence basis to write a data, and a sustaining interval for sustaining a luminescent state of the discharge cells 1 into which the data has been written. First, in the reset interval, a reset pulse is applied to the scanning/sustaining electrode lines Y to generate a reset discharge for initializing the discharge cells. At this time, a direct current for preventing an erroneous discharge is applied to the address electrode lines X. In the address interval, a scanning pulse SP is sequentially applied to the scanning/sustaining electrode lines Y and a data pulse Va synchronized with the scanning pulse SP is applied to the address electrode lines X. At this time, a desired level of direct current voltage is applied to the common sustaining electrode lines Z. This direct current voltage allows a stable address discharge to be generated between the address electrode line X and the scanning/sustaining electrode line Y. In the sustaining interval, a sustaining pulse SUS are alternately applied to the scanning/sustaining electrode lines Y and the common sustaining electrode lines Z to cause a sustaining discharge at the discharge cells selected in the address interval.

In the conventional PDP driven as mentioned above, in order to obtain a stable discharge characteristic during the address discharge, a pulse width Td of the data pulse Va for each sub-field is set to more than 2.5 μs. If a pulse width Td of the data pulse Va is set to a large value of more than 2.5 μs, then it is possible to prevent an erroneous discharge from being generated due to a discharge delay phenomenon that is an inherent property of the PDP. However, if so, a ratio occupied by the sustaining interval having an influence on real picture brightness in one frame of 16.67 ms is reduced to less than 30% to deteriorate picture brightness. Furthermore, in order to reduce a contour noise that is an inherent picture quality deterioration phenomenon of the PDP, the number of sub-fields in one frame interval is enlarged from eight into ten to twelve. However, if the number of sub-fields in the fixed one frame interval is enlarged, then each sub-field interval is shortened to that extent. In this case, since an address interval is fixed and a sustaining interval only is shortened for each sub-field so as to obtain a stable address discharge, picture brightness is lowered. Moreover, in the case of a high-resolution PDP having a very large number of scanning/sustaining electrode lines Y, a sustaining interval is too shortened to make a display itself. In the high-resolution PDP, the number of scanning lines has much larger value to more lengthen an address interval at which the scanning lines are sequentially driven for each sub-field. As a result, a sustaining interval is inevitably reduced during the fixed one frame interval to cause brightness deterioration.

SUMMARY OF THE INVENTION

Accordingly, it is an object of the present invention to provide a plasma display panel (PDP) and a driving method thereof that permit a high-speed addressing.

In order to achieve these and other objects of the invention, a plasma display panel according to one aspect of the present invention includes scanning/sustaining electrodes provided at each discharge cell; common sustaining electrodes formed in parallel to the scanning/sustaining electrodes at each discharge cell; and at least two dummy electrodes, being provided at a non-display area, for supplying the non-display area with charged particles in an address interval.

A plasma display panel according to another aspect of the present invention includes a dummy electrode driver for applying a dummy pulse to dummy electrodes such that the dummy electrodes formed at a non-display area can cause a first auxiliary discharge in an address interval; and a scanning/sustaining driver for sequentially applying an auxiliary pulse and a scanning pulse to scanning/sustaining electrodes such that the scanning/sustaining electrodes formed at a display area can sequentially cause a second auxiliary discharge and an address discharge in the address interval.

A method of driving a plasma display panel according to still another aspect of the present invention includes the step of applying a different polarity of pulses to scanning/sustaining electrodes in an address interval.

A method of driving a plasma display panel according to still another aspect of the present invention includes the steps of applying a dummy pulse to dummy electrodes positioned at a non-display area to cause a first auxiliary discharge for supplying discharge cells with charged particles; applying a positive auxiliary pulse and a negative scanning pulse to scanning/sustaining electrodes positioned at a display area in an address interval to cause a second auxiliary discharge and an address discharge; and applying a data pulse synchronized with the scanning pulse to address electrodes arranged perpendicularly to the scanning/sustaining electrodes to cause said address discharge between the address electrodes and the scanning/sustaining electrodes.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
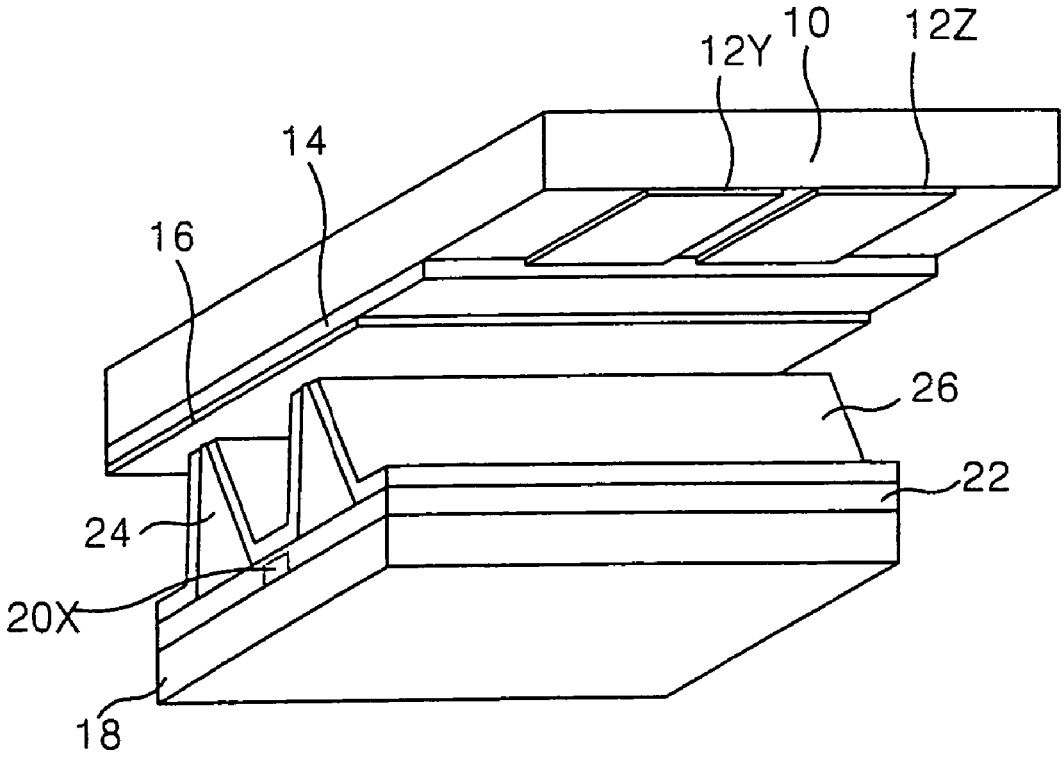
FIG. 1 CONVENTIONAL ART
FIG. 1 is a perspective view showing a structure of a discharge cell of a conventional three-electrode, AC surface discharge plasma display panel.
Figure 2:
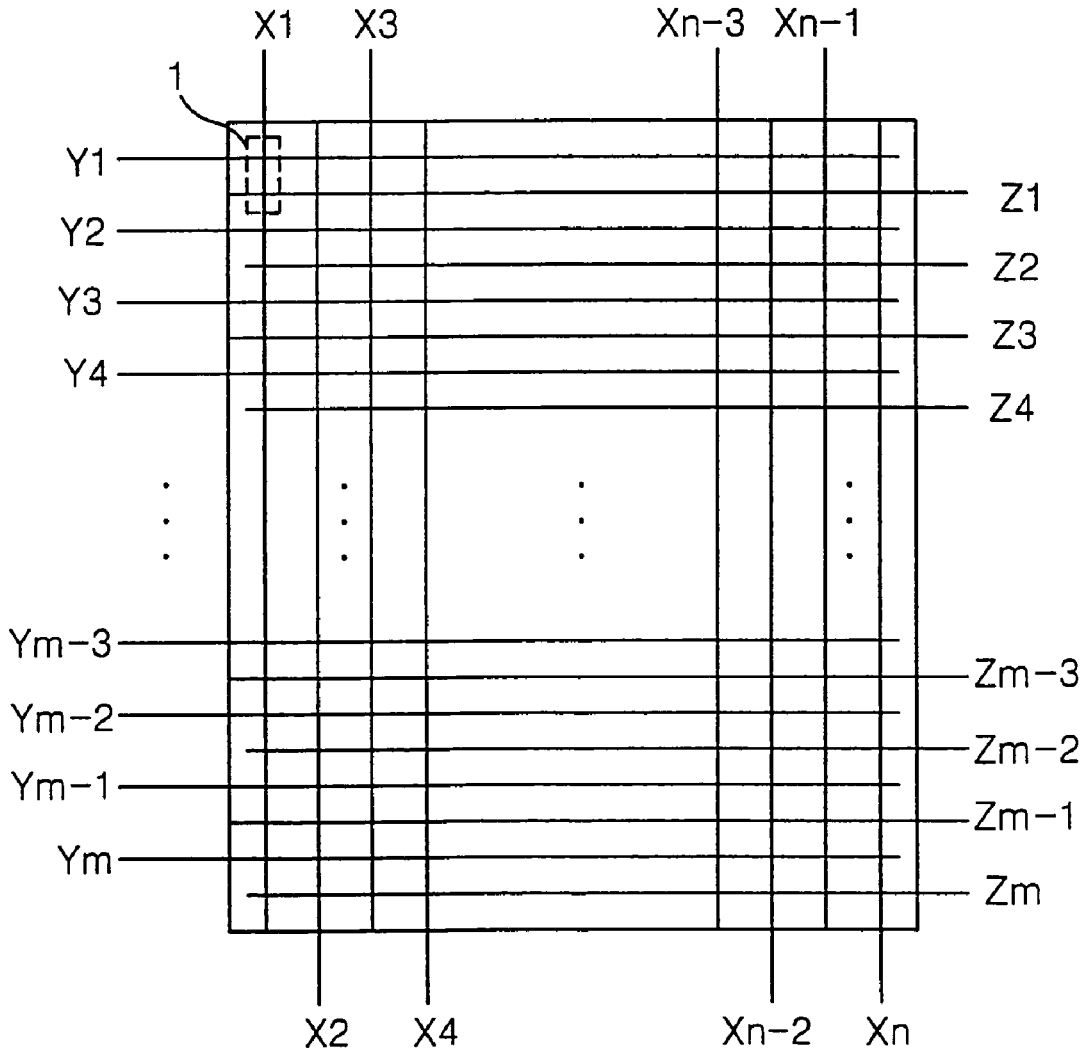
FIG. 2 CONVENTIONAL ART
FIG. 2 is a plan view showing an entire arrangement of the electrode lines and discharge cells of the plasma display panel in FIG. 1.
Figure 3:
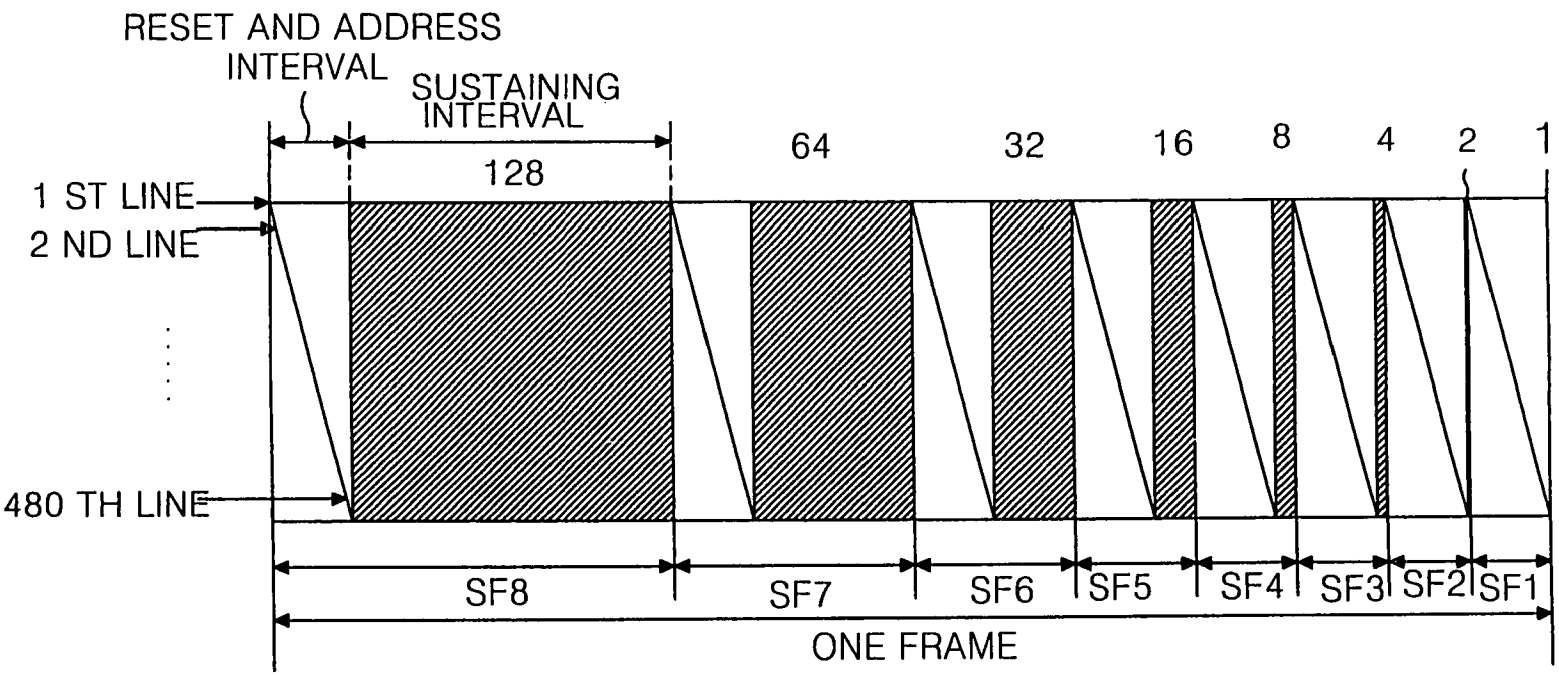
FIG.3 CONVENTIONAL ART
FIG. 3 depicts a driving method for expressing one frame gray scale of the plasma display panel shown in FIG. 1.
Figure 4:
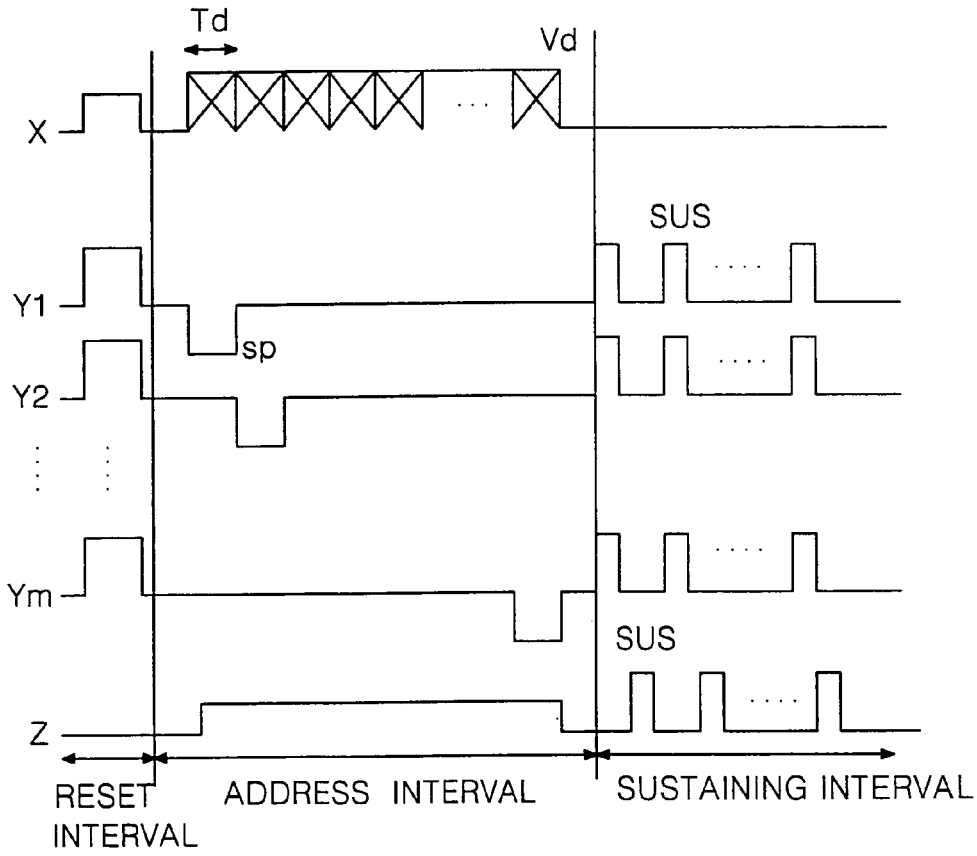
FIG. 4 CONVENTIONAL ART
FIG. 4 is waveform diagrams of driving signals to each electrode of the plasma display panel shown in FIG. 1.
Figure 5:
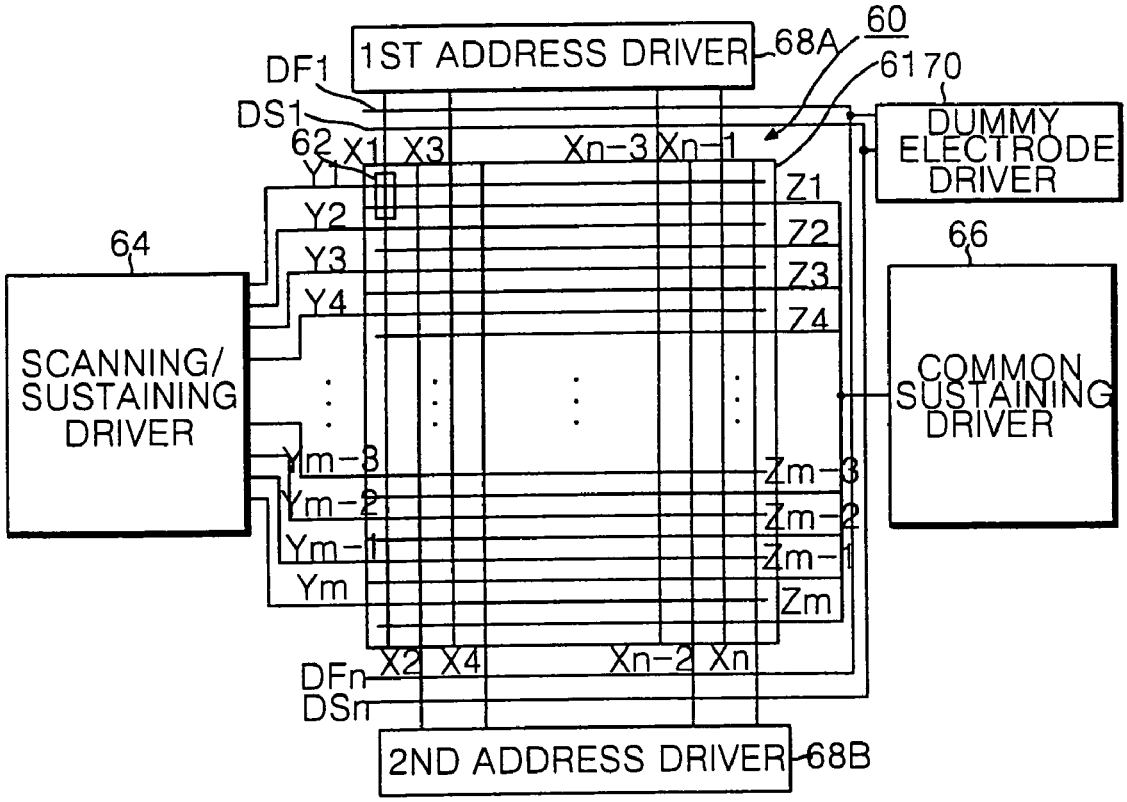
FIG. 5 is a plan view showing an entire arrangement of electrode lines and discharge cells of a plasma display panel according to an embodiment of the present invention.

Referring to FIG. 5, there is shown a driving apparatus for a plasma display panel (PDP) according to an embodiment of the present invention. The PDP driving apparatus includes a PDP 60 having m×n discharge cells 62 arranged in a matrix type at each intersection among scanning/sustaining electrode lines Y, common sustaining electrode lines Z and address electrode lines X, dummy electrodes DF and DS provided at the upper and lower portions of an effective display part 61 of the PDP 60, a scanning/sustaining driver 64 for driving the scanning/sustaining electrode lines Y, a common sustaining driver 66 for driving the common sustaining electrode lines Z, first and second address driver 68A and 68B for making a divisional driving of the address electrode lines X into the odd-numbered lines and the even-numbered lines, and a dummy electrode driver 70 for driving the dummy electrode lines DF and DS. The scanning/sustaining driver 64 sequentially applies a scanning pulse to the scanning/sustaining electrode lines Y to sequentially scan the discharge cells 62 line by line, and sequentially applies a sustaining pulse to the scanning/sustaining electrode lines Y to sustain a discharge at each of the m×n discharge cells 62. The common sustaining driver 66 applies a sustaining pulse to the common sustaining electrode lines Z to sustain a discharge at each of the m×n discharge cells 62 along with the scanning/sustaining electrode lines Y. The first and second address driver 68A and 68B applies a data pulse synchronized with the scanning pulse applied to the scanning/sustaining electrode lines Y to the address electrode lines X. The first address driver 68A supplies the odd-numbered address electrode lines X with an image data while the second address driver 68B supplies the even-numbered address electrode lines X with an image data. The dummy electrode driver 70 alternately applies a dummy pulse to the dummy electrode lines DF and DS during the address discharge interval. The dummy electrode lines DF and DS supplied with a dummy pulse cause a dummy to produce priming charged particles, which is in turn applied to the discharge cells 62. To this end, the dummy electrode lines DF and DS are formed in parallel to the scanning/sustaining electrode lines Y and the common sustaining electrode lines Z.

Figure 6:
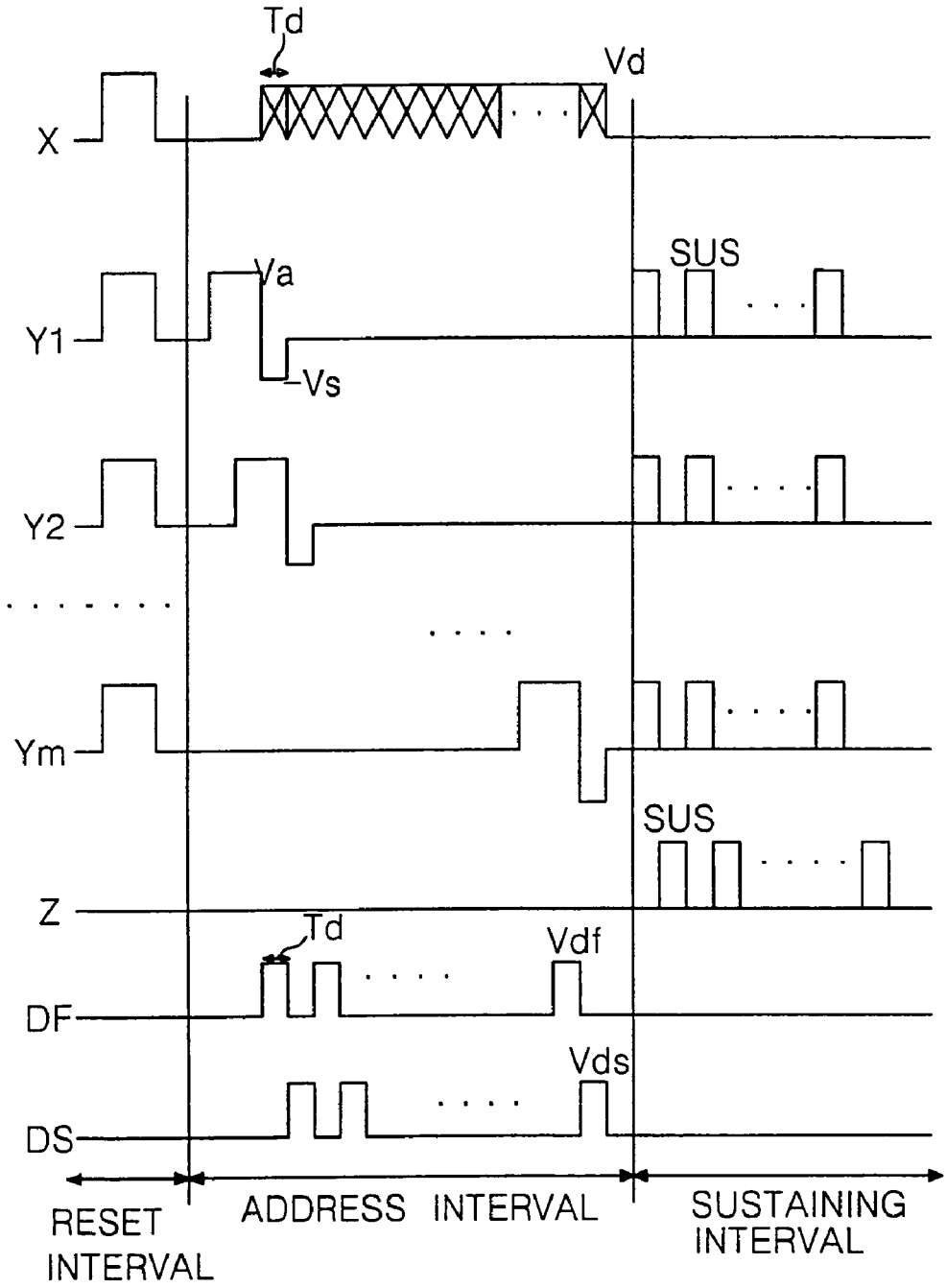
FIG. 6 is waveform diagrams of driving signals to each electrode of the plasma display panel shown in FIG. 5.
Figure 7:
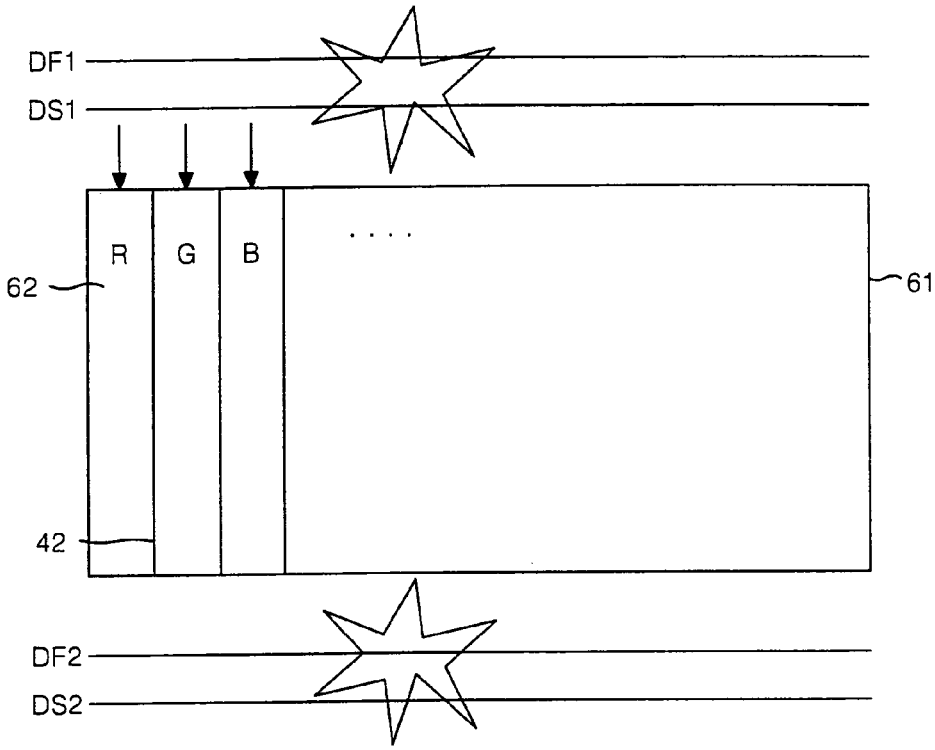
FIG. 7 illustrates a movement path of charged particles produced by the dummy electrodes shown in FIG. 5.
Figure 8A:
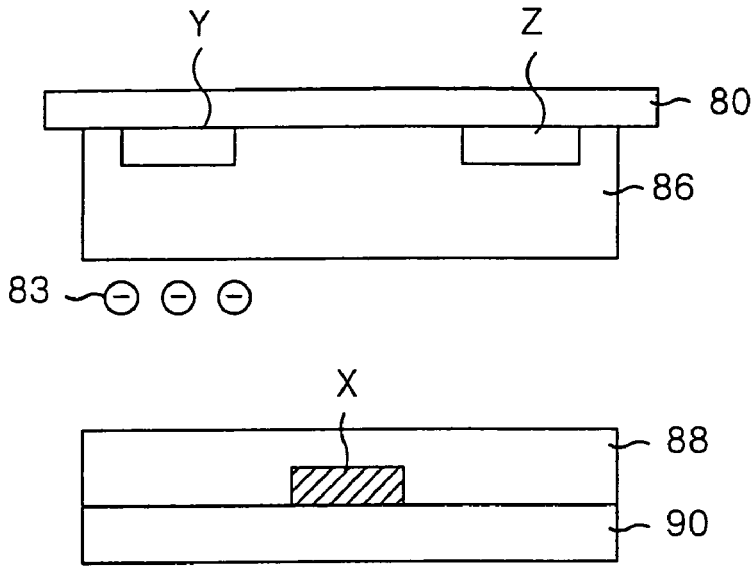
FIG. 8A and FIG. 8B are section views showing an address discharge of the plasma display panel in FIG. 5.
Figure 8B:
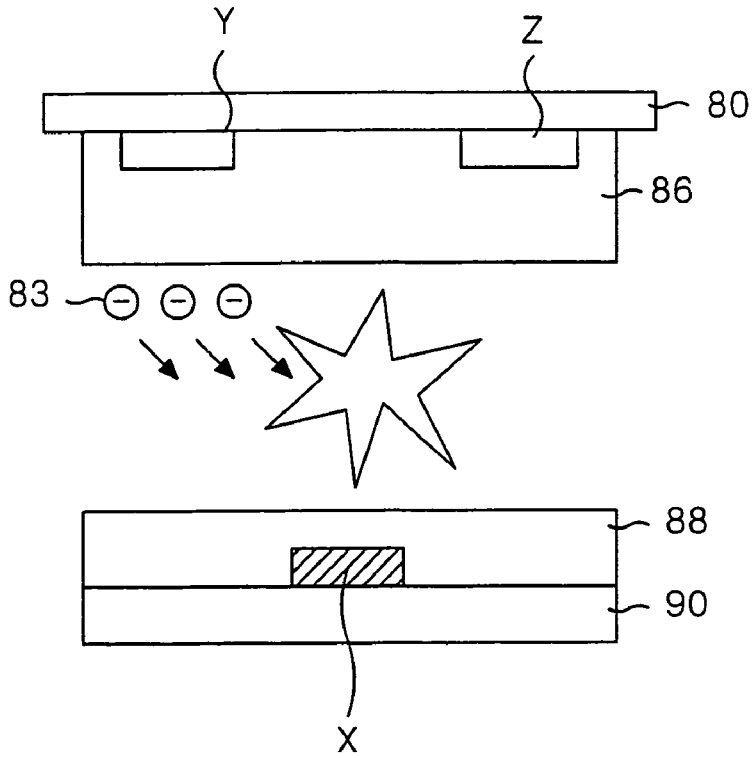

FIG. 6 is waveform diagrams of driving signals applied to each electrode line every sub-field in a method of driving the PDP according to the embodiment of the present invention. Referring now to FIG. 6, one sub-field is divided into a reset interval for initializing an entire field, an address interval for scanning the entire field on a line-sequence basis to write a data, and a sustaining interval for sustaining a luminescent state of the discharge cells 1 into which the data has been written. First, in the reset interval, a reset pulse is applied to the scanning/sustaining electrode lines Y to generate a reset discharge for initializing the discharge cells. At this time, a direct current for preventing an erroneous discharge is applied to the address electrode lines X. In the address interval, dummy pulses Vdf and Vds are alternately applied to the dummy electrode lines DF and DS to cause a dummy discharge. The priming charged particles produced by the dummy discharge are supplied to the discharge cells 62 as shown in FIG. 7 to easily generate an address discharge. Also, in the address interval, a scanning pulse −Vs is sequentially applied to the scanning/sustaining electrode lines Y and a data pulse Vd synchronized with the scanning pulse −Vs is applied to the address electrode lines X. At this time, an address discharge is generated at a discharge cell in which the data pulse Vd and the scanning pulse −Vs co-exist. Meanwhile, an auxiliary pulse Va having a voltage value enough not to generate an erroneous discharge is applied to the scanning/sustaining electrode lines Y prior to application of the scanning pulse −Vs. When a positive auxiliary pulse Va is applied to the scanning/sustaining electrode lines Y, then negative electric charges 83 are formed on an upper dielectric layer 86 as shown in FIG. 8A. At this time, the common sustaining electrode lines Z maintains a ground voltage so that the negative electric charges 83 can be easily formed on the upper dielectric layer 86. After the negative electric charges 83 were formed on the upper dielectric layer 86, a negative scanning pulse −Vs is applied to the scanning/sustaining electrode lines Y. When the scanning pulse −Vs is applied the scanning/sustaining electrode lines Y, an address discharge is generated between the scanning/sustaining electrode lines Y and the address electrode lines X supplied with the data pulse Vd as shown in FIG. 8B. At this time, a stable address discharge can be generated even when a pulse width Td of the data pulse Vd is shortened and a voltage level thereof is lowered, owing to the negative electric charges 83 pre-formed on the upper dielectric layer 86. Thus, a pulse width of the data pulse Vd can be shortened to approximately 1 μs. As the pulse width Td of the data pulse Vd is shortened, an address interval in each sub-field is largely reduced by more than twice in comparison to the prior art. In the sustaining interval, a sustaining pulse SUS are alternately applied to the scanning/sustaining electrode lines Y and the common sustaining electrode lines Z to cause a sustaining discharge at the discharge cells selected in the address interval.

As described above, according to the present invention, an auxiliary pulse is applied to the scanning/sustaining electrode lines in the address interval to produce sufficient charged particles prior to the address discharge. Also, a dummy pulse is applied to the dummy electrode line in the address interval to produce priming charged particles, and the produced charged particles are supplied to the discharge cells to easily generate an address discharge. Thus, the sufficient charged particles for an address discharge are supplied to the discharge cells, it becomes possible to shorten a pulse width of the data pulse and make a low voltage driving. Accordingly, the address interval for each sub-field is dramatically shortened in comparison to the prior art and hence the sustaining interval is enlarged to that extent, thereby largely improving picture brightness. In addition, a high-speed addressing is permitted, so that the number of sub-fields can be enlarged into more than ten in the case of driving a high-resolution panel Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel (PDP) having an address interval for selecting discharge cells, and a co-existing display area and non-display area, wherein the PDP comprises:

scanning/sustaining electrodes provided at each discharge cell;

common sustaining electrodes formed in parallel to the scanning/sustaining electrodes at each discharge cell; and at least two dummy electrodes formed in the non-display area, in parallel to the scanning/sustaining electrodes and the common sustaining electrodes; and a dummy electrode driver that applies a dummy pulse to the at least two dummy electrodes while a scanning pulse is applied to the scanning/sustaining electrodes during an address interval.

2. The plasma display panel as claimed in claim 1, wherein the common sustaining electrodes maintain a ground potential in the address interval.

3. The plasma display panel as claimed in claim 1, wherein an auxiliary pulse is applied to the scanning/sustaining electrodes before the scanning pulse is applied to the scanning/sustaining electrodes.

4. The plasma display panel as claimed in claim 3, wherein a polarity of the auxiliary pulse is different from a polarity of the scanning pulse.

5. The plasma display panel as claimed in claim 1, wherein the dummy pulse has a positive polarity.

6. A method of driving a plasma display panel (PDP) having an address interval for selecting discharge cells, and a co-existing display area and non-display area, the method comprising:

applying a scanning pulse to scanning/sustaining electrodes during an address interval; and applying a dummy pulse to dummy electrodes formed at a non-display area while the scanning pulse is applied to the scanning/sustaining electrodes, the dummy electrodes being oriented in parallel to common electrodes that are oriented in parallel to the scanning/sustaining electrodes.

7. The method as claimed in claim 6, wherein the dummy pulse is synchronized with the scanning pulse.

8. The method as claimed 6, further comprising applying an auxiliary pulse to the scanning/sustaining electrodes before applying the scanning pulse to the scanning/sustaining electrodes.

9. The method as claimed 8, wherein a polarity of the auxiliary pulse is different from a polarity of the scanning pulse.

10. The method as claimed 6, wherein the dummy pulse has a positive polarity.

11. A plasma display panel (PDP) having an address interval for selecting discharge cells, and a co-existing display area and non-display area, the PDP comprising:

scanning/sustaining electrodes provided at each discharge cell;

common sustaining electrodes formed in parallel to the scanning/sustaining electrodes at each discharge cell;

at least two dummy electrodes formed at a non-display area, in parallel to the scanning/sustaining electrodes and the common sustaining electrodes;

a dummy electrode driver that applies a voltage to the dummy electrodes; and a scanning/sustaining driver that applies a positive voltage and a ground voltage to the scanning/sustaining electrodes, and then applies a negative voltage the scanning/sustaining electrodes.

* * * * *